US005466210A

United States Patent [19]

Wilcox

[11] Patent Number: 5,466,210

[45] Date of Patent: Nov. 14, 1995

[54] APPARATUS FOR OPENING TUBE MATERIAL

[75] Inventor: Karl M. Wilcox, Chesterfield, Va.

[73] Assignee: Reynolds Metals Company, Richmond, Va.

[21] Appl. No.: 216,443

[22] Filed: Mar. 23, 1994

[51] Int. Cl.[6] ..... B65B 43/26; B65B 65/00; B31B 23/36

[52] U.S. Cl. ..... 493/309; 493/410; 493/416; 493/436; 493/440; 53/291; 53/567

[58] Field of Search ..... 493/309, 310, 493/311, 405, 410, 416, 436, 439, 440, 443, 302, 248, 295, 257, 934; 53/290, 291, 256, 459, 567

[56] References Cited

U.S. PATENT DOCUMENTS

| | | | |
|---|---|---|---|
| 3,059,548 | 3/1960 | Kaplan | 93/20 |
| 3,070,927 | 1/1963 | Lundahl | 53/29 |
| 3,334,466 | 8/1967 | Scholle | 53/28 |
| 3,354,680 | 11/1967 | Jacobsen | 72/126 |
| 3,397,564 | 8/1968 | Schroeder | 72/113 |
| 3,400,033 | 9/1968 | Galimberti | 493/309 |
| 3,403,543 | 10/1968 | Gregory et al. | 72/398 |
| 3,412,656 | 3/1966 | Corneliusson | 493/302 |
| 3,736,846 | 6/1973 | Frankenberg | 93/82 |
| 3,946,644 | 3/1976 | Feldkamper | 493/309 |
| 4,120,323 | 10/1978 | Saul | 493/295 |
| 4,134,287 | 1/1979 | Le Huede et al. | 72/370 |
| 4,230,030 | 10/1980 | Hanson et al. | 93/355 B |
| 4,255,223 | 3/1981 | Saul | 493/295 |
| 4,309,861 | 1/1982 | Karpisek | 53/556 |
| 4,553,376 | 11/1985 | Okada | 56/567 |
| 4,666,423 | 5/1987 | Herrington | 493/394 |
| 4,693,059 | 9/1987 | O'Donnell | 53/567 |
| 4,783,949 | 11/1988 | Chopko | 493/309 |
| 4,910,941 | 3/1990 | Nagano | 56/291 |
| 4,914,893 | 4/1990 | Strub et al. | 53/567 |
| 5,024,049 | 6/1991 | Strub et al. | 53/585 |

*Primary Examiner*—Bruce M. Kisliuk
*Assistant Examiner*—Christopher W. Day
*Attorney, Agent, or Firm*—Alan T. McDonald

[57] ABSTRACT

A tube material opening apparatus includes two pairs of rotatable wheels which are positioned at upstream and downstream locations within tube material. The peripheral edge of each rotatable wheel is rounded or tapered and contacts the inner surface of the tube material as the material travels in a longitudinal direction. The wheels are mounted to provide appropriate lateral tension to the tube material. The apparatus may include T-shaped bearing members or positioning rollers for maintaining the rotatable wheel positioning within the tube material.

3 Claims, 9 Drawing Sheets

APPARATUS FOR OPENING TUBE MATERIAL

TECHNICAL FIELD

This invention relates generally to an apparatus for opening tube material, and more particularly to a tube material opening apparatus of a type incorporating an internal opening wedge.

BACKGROUND ART

Tube material, such as T/E (Tamper Evident) tube stock, is rolled and stocked prior to use. This rolling and stocking causes the tube material to be flattened and for its inner surfaces to bond to each other; therefore, it is necessary to separate the bonded surfaces of the flattened material from each other in order to put the tube material in practical use. For opening such tube material, an opening wedge positioned within the tube material is generally used.

As the tube material travels in a longitudinal direction, the tube material is automatically opened by the wedge. Typically, the opening wedge is located between two pairs of parallel rollers which are mounted at upstream and downstream ends of the tube material. The rollers guide the tube material as it travels between them.

Some conventional wedges are made of solid metal or plastic. Others are made of sheet metal shaped and welded to form a shell. Still other conventional opening wedges are made of solid plastic with spring loaded wings or of metal rods formed into a frame. Some conventional opening wedges are adjustable and/or spring loaded.

However, there are disadvantages with conventional opening wedges. One disadvantage is that surface contact between the opening wedge and tube material causes unacceptable friction between them. This results in static electricity which prevents the layers of tube material from separating from each other easily.

Also, with conventional opening wedges, the tube material may jam between the opening wedge and the parallel rollers, because the opening wedge is forced into the downstream parallel rollers with the tube material due to friction.

Accordingly, an object of the present invention is to provide an apparatus for opening tube material in which friction between the apparatus and the tube material is reduced.

Another object of the invention is to provide an apparatus for opening tube material in which the incidence of jamming is reduced.

Additional objects, advantages and novel features of the present invention will become apparent to those skilled in the art from this disclosure, including the following detail description, as well as by practice of the invention. While the invention is described below with reference to preferred embodiments, it should be understood that the invention is not limited thereto. Those of ordinary skill in the art having access to the teachings herein will recognize additional applications, modifications and embodiments in other fields, which are within the scope of the invention as disclosed and claimed herein and with respect to which the invention could be of significant utility.

DISCLOSURE OF THE INVENTION

According to one aspect of the invention, a device for opening tube material traveling in a longitudinal direction, includes two pairs of rotatable wheels. The two pairs of rotatable wheels are at upstream and downstream positions within the tube material, respectively. Each rotatable wheel peripherally contacts the inner surface of the tube material. The rotatable wheels can, if desired, provide predetermined lateral tension to the tube material.

Preferably, each rotatable wheel has a periphery which is rounded, although a tapered periphery may be suitable for some applications. A mount for adjustably mounting the rotatable wheels so as to control the lateral tension to the tube material may also be provided. One pair of rotatable wheels is mounted so as to apply lateral tension to the tube material in a first longitudinal plane, and the other pair of rotatable wheels is mounted so as to apply lateral tension to the tube material in a second longitudinal plane. These longitudinal planes are angled to each other, for example at ninety degrees. The device also includes a positioning member for positioning the two pairs of rotatable wheels within the tube material.

According to another aspect of the invention, an apparatus for opening tube material traveling in a longitudinal direction has two pairs of guide members between which the tube material travels. An opening wedge, or other device, for opening the tube material and a positioning member for positioning the opening device between the two pairs of guide members are disposed within the tube material between the two pairs of guide members.

Preferably, the positioning member separates the opening device from the guide members. The guide members are normally two pairs of parallel rollers which are at upstream and downstream ends of the tube material. The opening means preferably include rotatable members. The positioning member has bearing members which may include two sets of rotatable members but preferably comprise two T-shaped members formed of aluminum and having a hard, slip coating. One of the bearing members is opposed to and bears against one pair of parallel rollers with the tube material in between, and the other bearing member is opposed to and bears against the other pair of parallel rollers also with the tube material in between. Thus, the bearing members are supported by the parallel rollers. If rotatable members are used, at least one of the rotatable members of each set can, if desired, be arranged so as to rest against a single parallel roller, with the other rotatable members of the set arranged so as to rest against only the other parallel roller.

According to further aspects of the invention, the two sets of rotatable members are each comprised of three rollers, and the offset roller in each set is a middle roller.

BEST MODE FOR CARRYING OUT THE INVENTION

Figure 1:
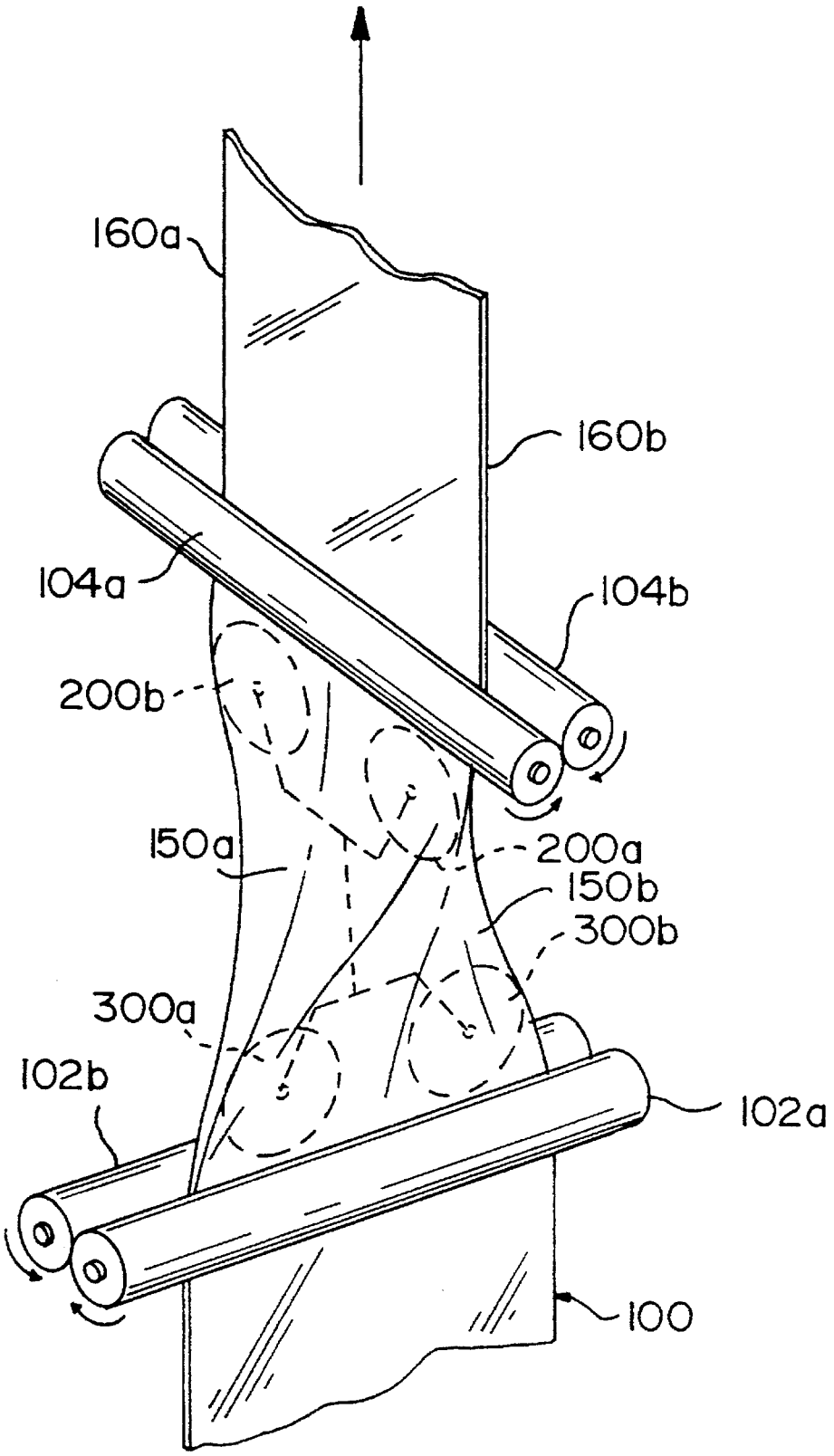
FIG. 1 is a perspective view illustrating tube material and an opening apparatus in accordance with the present invention.
Figure 2:
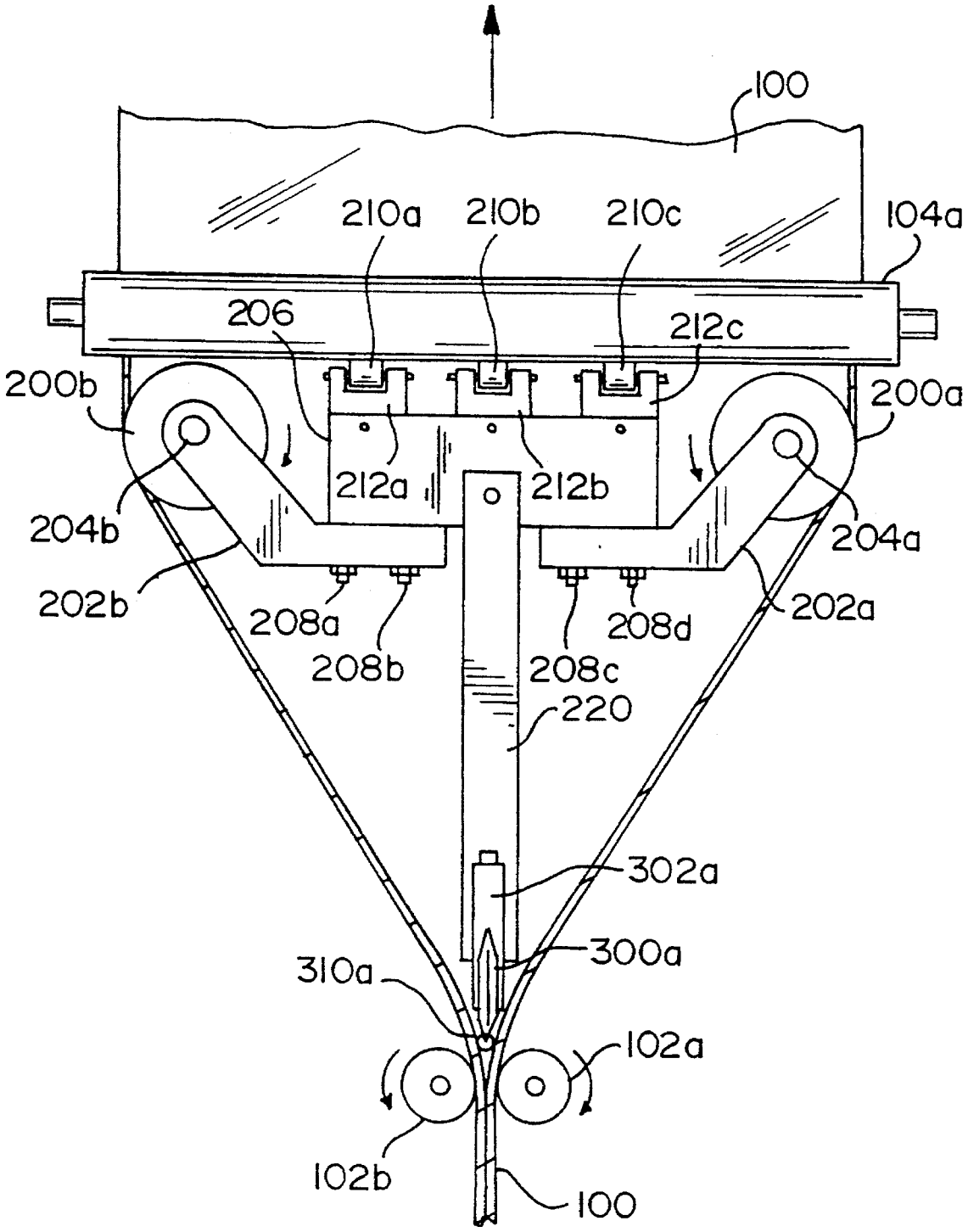
FIG. 2 is a front view showing the a first embodiment of the opening apparatus in accordance with the present invention.

Reference is now made to FIG. 1 of the drawings, which shows respectively tube material 100, such as T/E (Tamper Evident) tube stock, being opened by an opening wedge in accordance with the present invention. The tube material may be of paper, plastic sheet or the like.

Tube material 100 travels in a longitudinal direction (shown by the arrows) between two pairs of parallel trap or guide rollers 102*a* and 102*b*, and 104*a* and 104*b*. The opening wedge is positioned within tube material 100 between the roller pairs.

Figure 3:
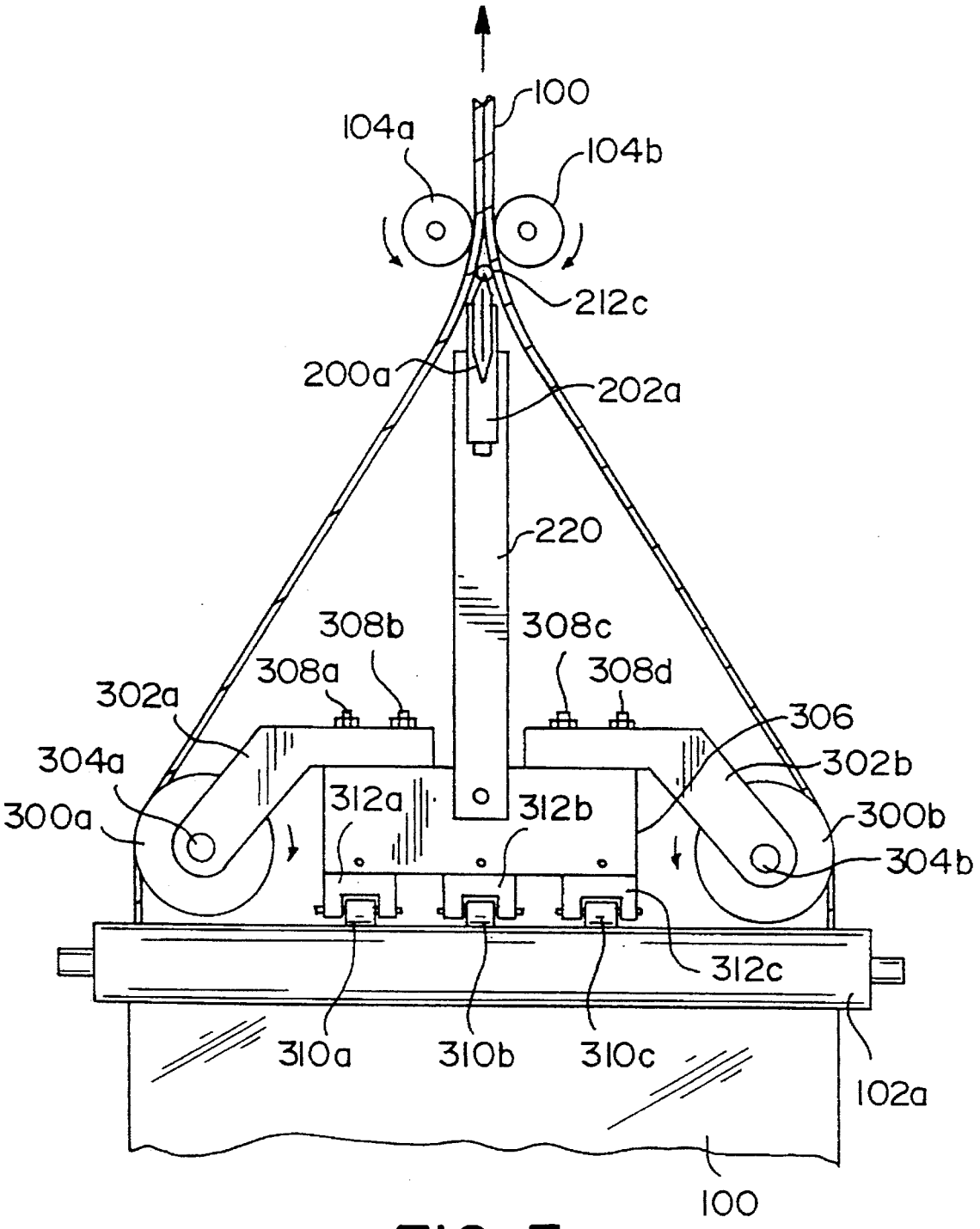
FIG. 3 is a side view of the apparatus shown in FIG. 2.

FIGS. 2–5 depict various aspects of one embodiment of the present invention. This first embodiment is most suitable for operations which are not at high speeds. The opening wedge includes two pairs of wheels 200*a* and 200*b* (FIG. 2), and 300*a* and 300*b* (FIG. 3). Four wheel mounts 202*a*, 202*b*, 302*a* and 302*b* are provided for mounting the wheels 200*a*, 200*b*, 300*a* and 300*b* using pins 204*a*, 204*b*, 304*a* and 304*b*, respectively. Two cross bars 206 and 306 are attached to two pairs of wheel mounts 202*a* and 202*b*, and 302*a* and 302*b* using two sets of four bolts 208*a*, 208*b*, 208*c* and 208*d*, and 308*a*, 308*b*, 308*c* and 308*d*, respectively. Two sets of three positioning rollers 210*a*, 210*b* and 210*c*, and 310*a*, 310*b* and 310*c* are attached to roller mounts 212*a*, 212*b*, 212*c*, 312*a*, 312*b* and 312*c*. The mounts are attached to the cross bars 206 and 306. A connection bar or strut 220 connects to the cross bars 206 and 306.

The pairs of trap rollers are arranged to have a predetermined distance between each other, and to be freely rotatable.

The wheels 200*a*, 200*b*, 300*a* and 300*b* are mounted to be freely rotatable around the axes of pins 204*a*, 204*b*, 304*a* and 304*b*, respectively. The pins in each pair are arranged to be equal distance from rollers 104*a* and *b* or 102*a* and *b*, respectively.

The wheel mounts 202*a*, 202*b*, 302*a* and 302*b* are adjustable so as to control lateral tension to the tube material 100 applied by the wheels 200*a*, 200*b*, 300*a* and 300*b*.

The cross bars 206 and 306 are preferably arranged at an angle of ninety degrees to each other. The cross bars 202 and 302 may be spring loaded to automatically adjust to variations in the material dimension.

The positioning rollers 210*a*, *b* and *c* and 310*a*, *b* and *c* rest against trap rollers 102*a* and *b* and 104*a* and *b*, and distance the wheels 200*a*, 200*b*, 300*a* and 300*b* from the trap rollers. Thus, only the positioning rollers and not the wheels rest against the trap rollers. Other kinds of rotatable members, such as balls, could be used instead of the depicted positioning rollers as long as they are freely rotatable in the necessary direction.

Figure 4:
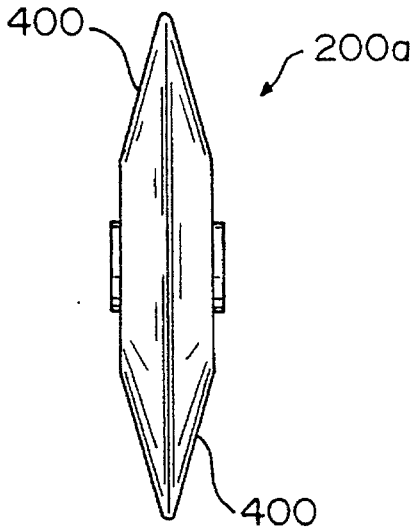
FIG. 4 is a front view illustrating an opening wheel of the apparatus shown in FIG. 2.

Referring to FIG. 4, each wheel is shaped to have a tapered periphery edge 400, as shown. Only the tapered edge contacts the tube material 100. Conventional techniques can be used to select the angle of the tapered edge 400 based on the thickness and quality of the tube material 100.

Figure 5:
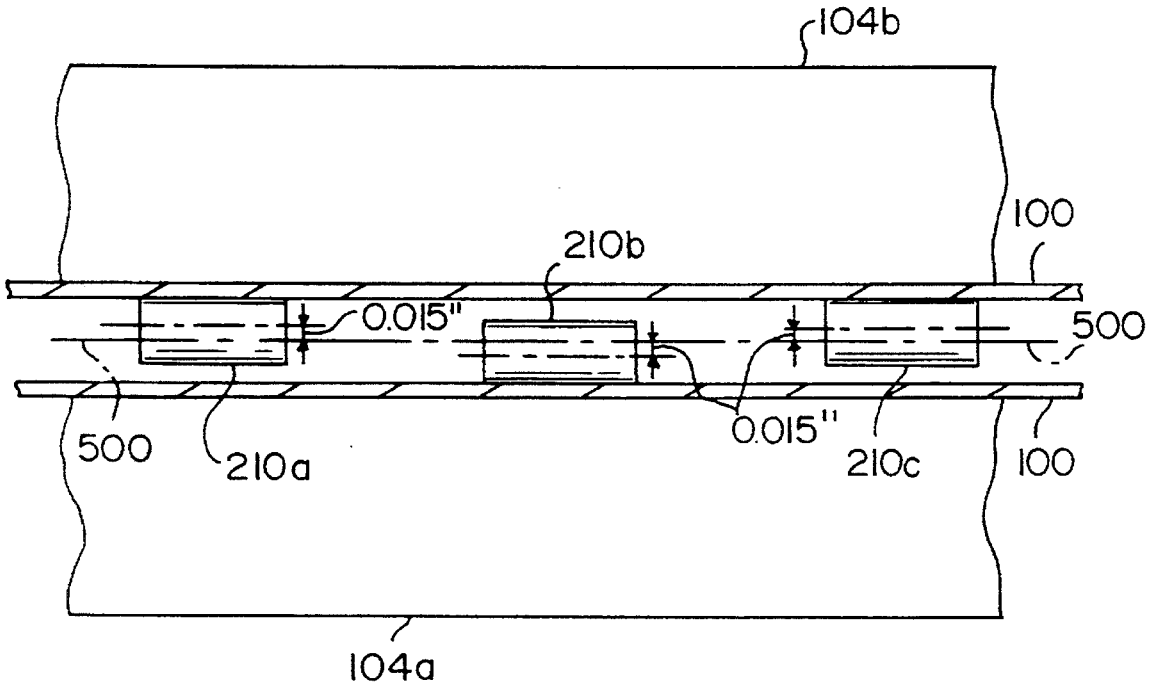
FIG. 5 is a view showing the relation between guide rollers and positioning rollers of the apparatus shown in FIG. 2.

As shown in FIG. 5, each set of positioning rollers have two axes, which are parallel to each other and to the axes of one pair of trap rollers, i.e. the pair upon which the positioning rollers in the set rest. At least one roller in each set is offset from the others. For example, in the set of positioning rollers 210*a*, 210*b* and 210*c*, the end rollers 210*a* and 210*c* are both offset 0.015 inch from the center line 500 of trap rollers 104*a* and 104*b* in the same direction so as to rest against only the trap roller 104*b*, and the center roller 210*b* is offset 0.015 inch in the other direction so as to rest against only the trap roller 104*a*.

The other set of positioning rollers 310*a*, 310*b* and 310*c* are arranged in the same manner as the above mentioned set. The offset distance is not limited by 0.015 inch, which may be changed depending on the thickness of the tube material 100, the space between the trap rollers of each pair, or other application specific consideration.

Before processing, the opening wedge is inserted into the tube material 100 so that the periphery edges of the upstream pair of wheels 300*a* and 300*b* are positioned so as to track the original manufacturing creases 150*a* and 150*b* of the tube material 100, as shown in FIG. 1. When the tube material 100 travels between the two pairs of trap rollers 102*a* and 102*b*, and 104*a* and 104*b*, the upstream wheels 300*a* and 300*b* track the original crease lines 150*a* and 150*b* with appropriate tension so that the tube material 100 is opened to some extent. Further downstream, wheels 200*a* and 200*b* apply appropriate tension to tube material 100 to create new crease lines 160*a* and 160*b* which are angled at ninety degrees from the original crease lines 150*a* and 150*b*. Thus, the tube material 100 is further opened, just before it enters the trap rollers 104*a* and 104*b*.

During the opening process, the positioning rollers 210*a*, 210*b*, 210*c*, 310*a*, 310*b* and 310*c* keep wheels 200*a*, 200*b*, 300*a* and 300*b* separated from the trap rollers 102*a*, 102*b*, 104*a* and 104*b*, so that the tube material 100 passes between the trap rollers without pinching or binding. When tube material 100 travels between trap rollers 104*a* and 104*b*, the tube material is re-closed with a small opening or gap left between the inner surfaces, so that the tube material is easy to re-open.

FIGS. 6–10 show a second and most preferred embodiment of an opening wedge in accordance with the present invention. This embodiment is particularly beneficial in high speed operations. The FIGS. 6–10 embodiment is identical to that depicted in FIGS. 2–5 except for the substitution of (i) rounded periphery wheels 600 *a* and *b* and 700*a* and *b* for the tapered periphery wheels of the embodiment of FIGS. 2–5 and (ii) the two T-shaped members 610 and 710 for the two sets of positioning rollers and roller mounts of the FIGS. 2–5 embodiment. Other features of the second embodiment of the opening wedge are as described with reference to FIGS. 2–5 above.

Figure 6:
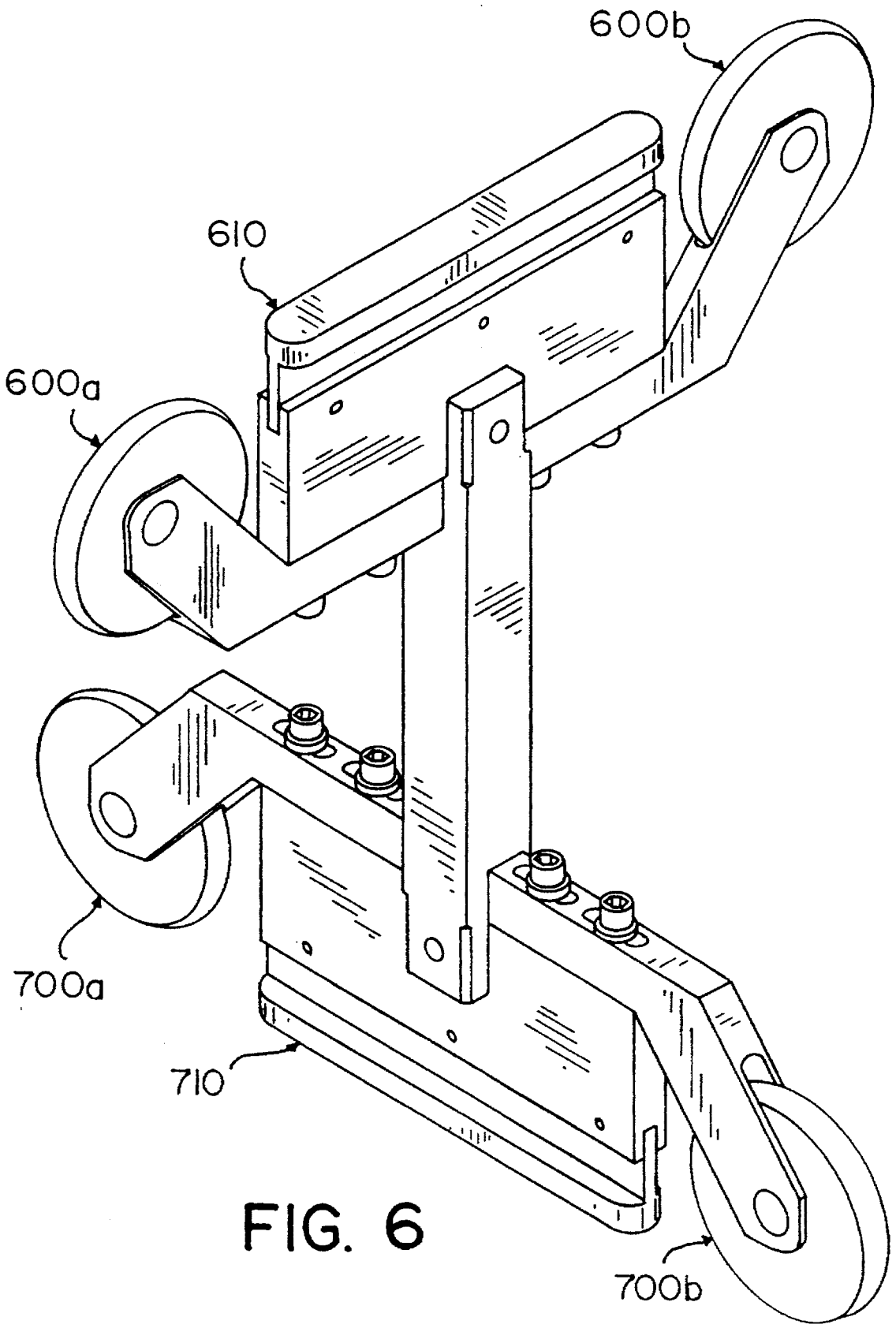
FIG. 6 is a perspective view showing a second embodiment of the opening apparatus in accordance with the present invention.
Figure 7:
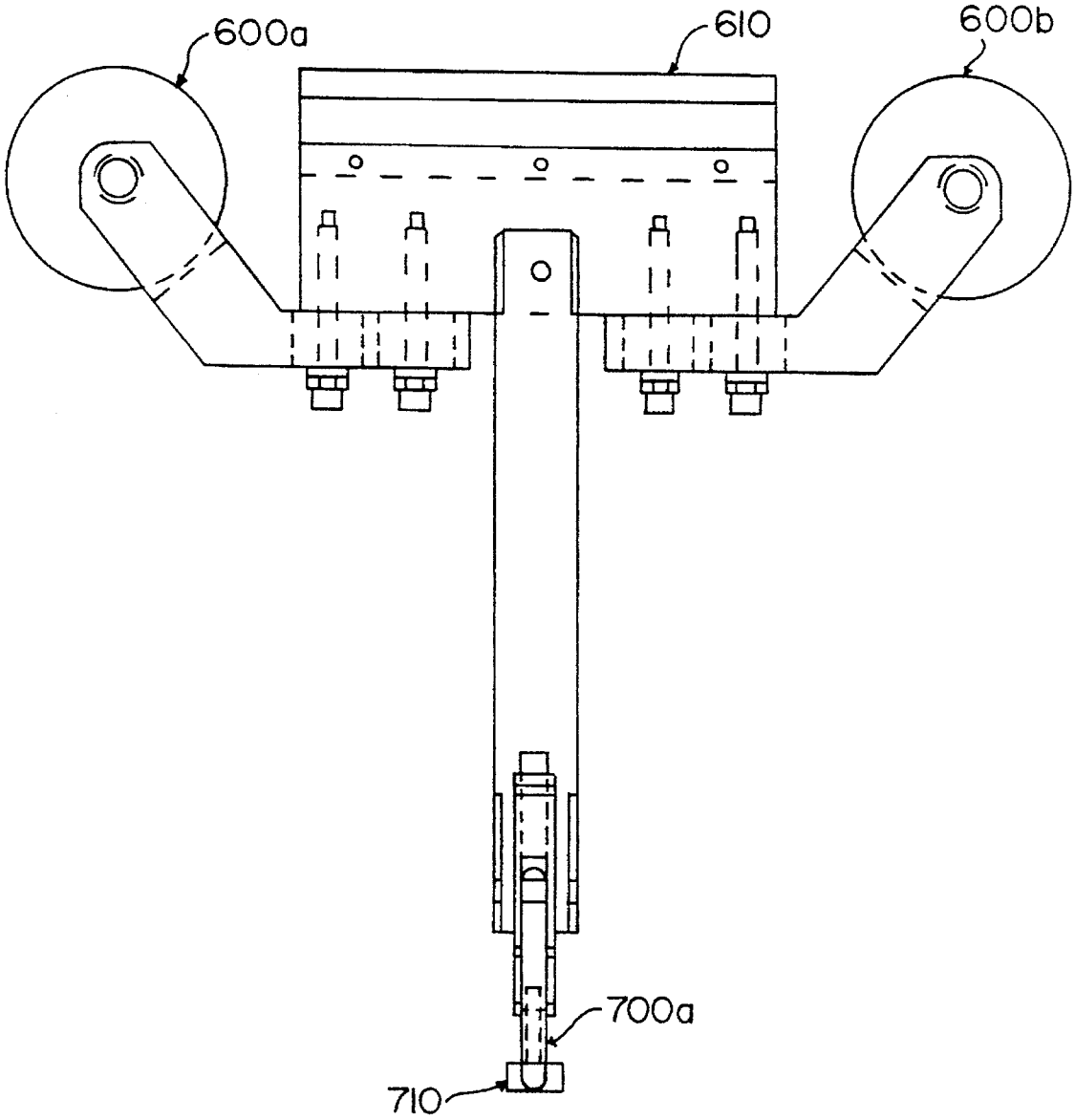
FIG. 7 is a front view of the apparatus shown in FIG. 6.
Figure 8:
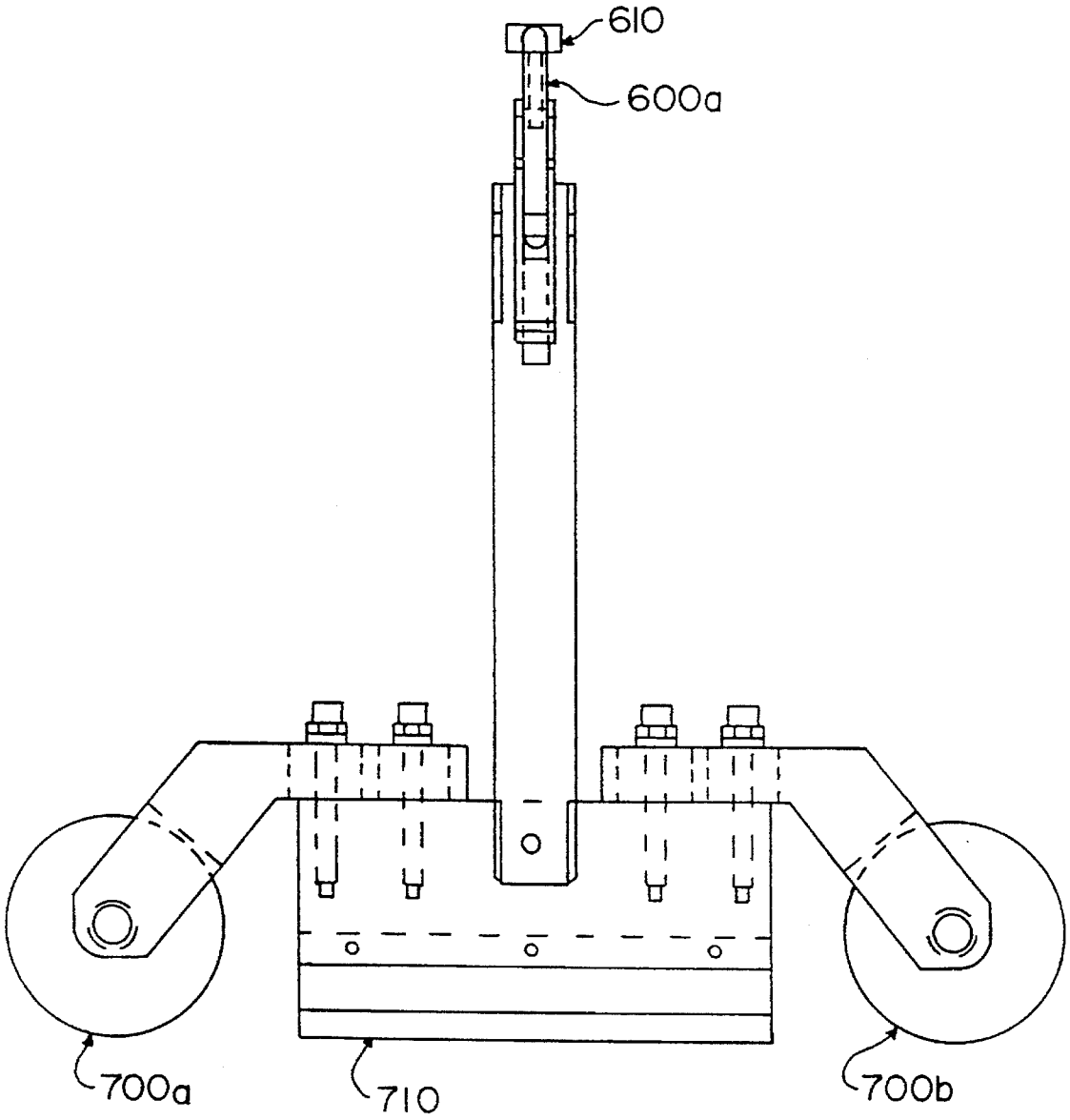
FIG. 8 is a side view of the apparatus shown in FIG. 6.
Figure 9:
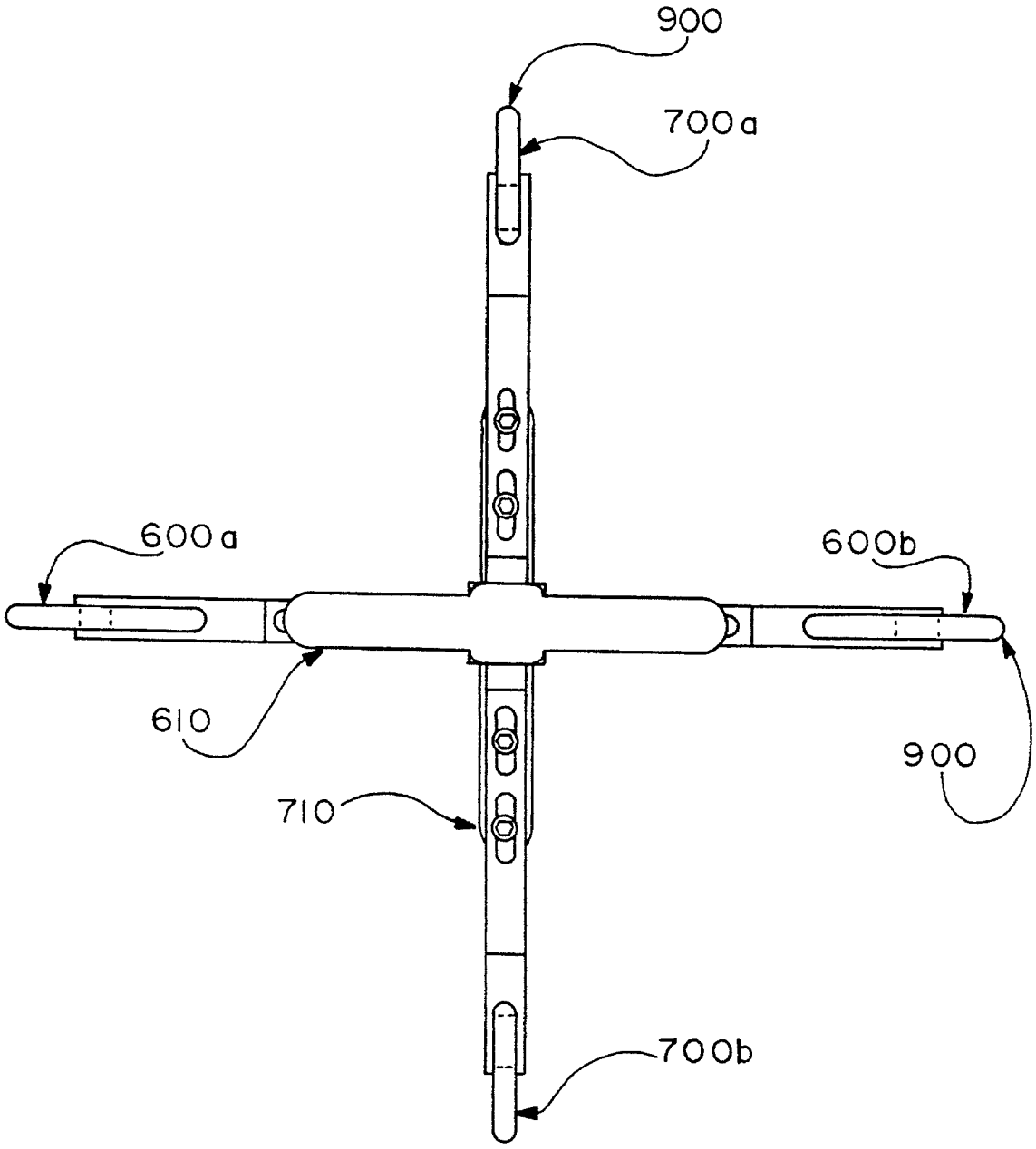
FIG. 9 is a top view of the apparatus shown in FIG. 6.

Referring now to FIGS. 6–9, the opening wedge includes two pairs of wheels 600*a* and 600*b* (FIGS. 6, 7 and 9) and 700*a* and 700*b* (FIGS. 6, 8 and 9). The wheels are mounted on four wheel mounts using pins as depicted in FIGS. 2–5. Two T-shaped positioning members 610 and 710 are attached to cross-bars identical to those shown in FIGS. 2–5.

The wheels 600*a* and *b* and 700*a* and *b* are mounted to be freely rotatable about the axis of the supporting pins which are arranged an equal distance from the trap rollers against which the T-shaped positioning members will bear.

As in the prior embodiment, the wheel mounts are adjustable so as to control lateral tension to the tube material 100 applied by the wheels 600*a* and *b* and 700*a* and *b*.

The T-shaped positioning members rest against trap rollers 102*a* and *b* and 104*a* and *b* and distance the wheels 600*a* and *b* and 700*a* and *b* from the trap rollers. Thus, only the T-shaped positioning members and not the wheels rest against the trap rollers.

The T-shaped positioning members are preferably formed of aluminum with a hard, slip coating formed at least on those surfaces which will contact the tubular material and bear against the trap rollers. Other materials such as steel or hard plastic or even aluminum without a hard, slip coating might be suitable for certain applications.

As shown in FIG. 9, each wheel is shaped to have a full radius rounded periphery edge 900. Only the rounded edge contacts the tube material 100. Conventional techniques can be used to select the radius of the rounded edge 900, based on the thickness and quality of the tubular material 100.

Figure 10:
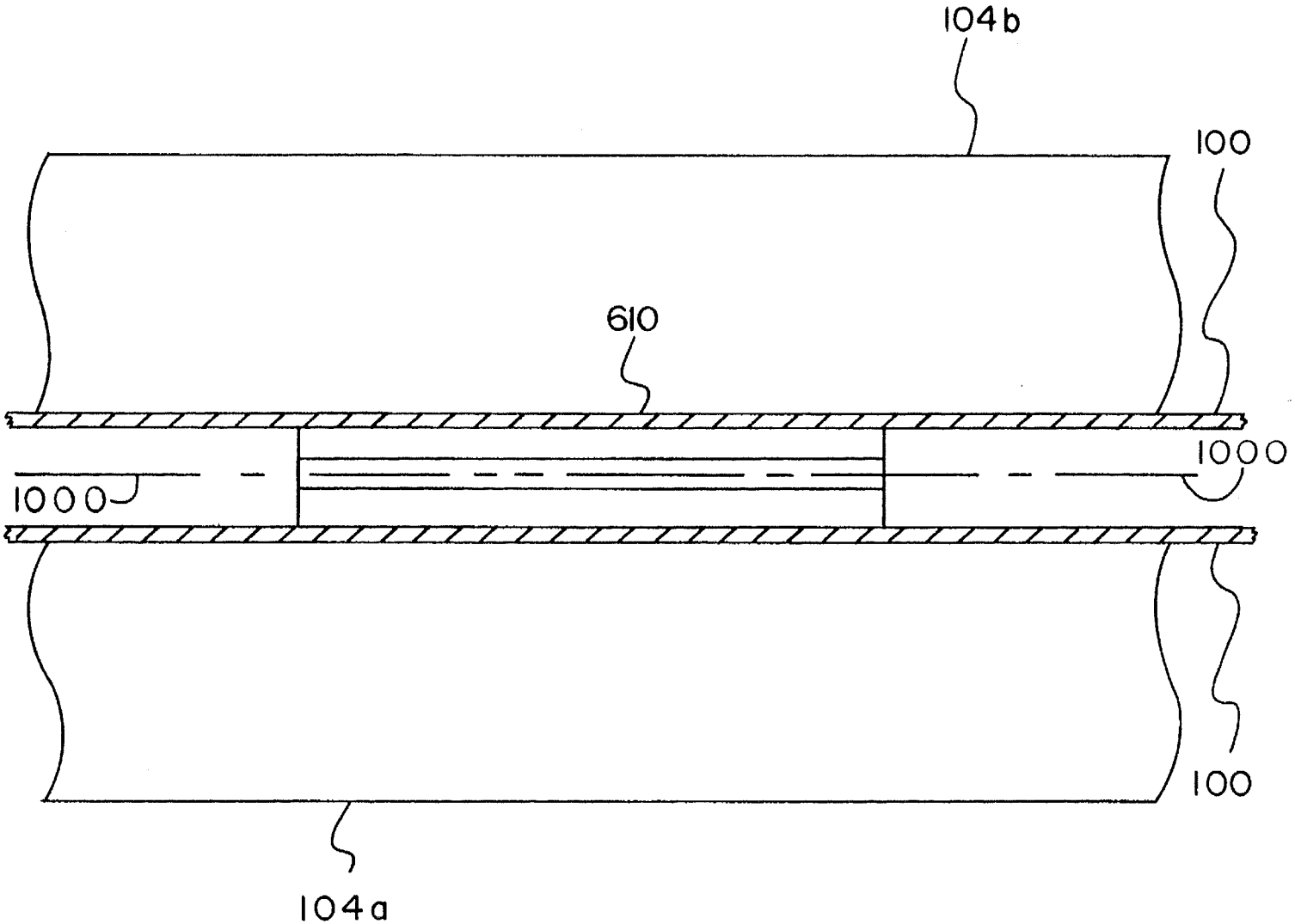
FIG. 10 is a view showing the relationship between the guide rollers and the T-shaped positioning members of the apparatus of FIG. 6.

During the opening process, the positioning members 610 and 710 keep wheels 600*a* and b and 700*a* and *b* separated from the trap rollers 102*a* and *b* and 104*a* and *b* so that the tube material 100 passes between the trap rollers without pinching or binding. FIG. 10 shows the preferred alignment of the T-shaped positioning member with the trap rollers. As to be seen, positioning members 610 is longitudinally centered along the center line 1000 of trap roller pair 104*a* and 104*b*. The tubular material 100 is positioned between trap rollers 104*a* and *b* and the positioning members 610. The arrangement of positioning member 710 with respect to trap rollers 102*a* and *b* will be understood to be identical to that shown in FIG. 10.

The present invention as described above provides an opening apparatus having reduced friction with the tube material, because only the peripheries of the rotatable wheels contact the tube material. The described invention also provides a tube opening apparatus with reduced incidence of jamming, because the rollers maintain the opening wedge positioning within the tube material.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed is:

1. An apparatus for opening tube material traveling in a longitudinal direction, comprising:

first and second pairs of parallel rollers between which the tube material travels;

first and second pairs of rotatable wheels which are to be located at upstream and downstream positions within the tube material, respectively, and between said first and second pairs of parallel rollers, wherein each rotatable wheel is to peripherally contact the tube material;

a first mount to which said first pair of rotatable wheels are mounted so as to apply lateral tension to the tube material in one direction, and a second mount to which said second pair of rotatable wheels are mounted so as to apply lateral tension to the tube material in a different direction;

first and second sets of three positioning rollers respectively mounted to said first and second mounts so as to be respectively positioned between rotatable wheels of the first and second pairs of rotatable wheels, wherein a middle positioning roller of the first set of positioning rollers is offset with respect to other positioning rollers of said set so as to oppose a first roller of the first pair of parallel rollers and the other positioning rollers of said first set of positioning rollers oppose a second roller of the first pair of parallel rollers, and a middle positioning roller of the second set of. positioning rollers is offset with respect to other positioning rollers of said set so as to oppose a first roller of the second pair of parallel rollers and the other positioning rollers of said second set of positioning rollers oppose a second roller of the second pair of parallel rollers; and a strut connected to and separating said first mount and said second mount.

2. The apparatus of claim 1, wherein:

each rotatable wheel has a rounded periphery.

3. The apparatus of claim 1, wherein:

each rotatable wheel has a tapered periphery.

* * * * *